United States Patent [19]

Suga et al.

[11] Patent Number: 4,809,514

[45] Date of Patent: Mar. 7, 1989

[54] APPARATUS FOR REMOVING SNOW DEPOSITED ON WALL OF SNOW GENERATING APPARATUS

[75] Inventors: Nagaichi Suga; Yoshio Sasho; Taro Mori, all of Tokyo, Japan

[73] Assignee: Suga Test Instruments Co., Ltd., Tokyo, Japan

[21] Appl. No.: 153,424

[22] Filed: Feb. 8, 1988

[30] Foreign Application Priority Data

Feb. 9, 1987 [JP] Japan ..... 62-17907[U]

[51] Int. Cl.[4] ..... F25C 3/04

[52] U.S. Cl. ..... 62/138; 62/74; 239/14.2

[58] Field of Search ..... 239/2.2, 14.2, 70; 62/74, 138, 140

[56] References Cited

U.S. PATENT DOCUMENTS

| | | | |
|---|---|---|---|
| 4,045,971 | 9/1977 | Brenner, Jr. | 62/140 |
| 4,694,656 | 9/1987 | Lane et al. | 62/74 |
| 4,746,064 | 5/1988 | Isono et al. | 239/14.2 |
| 4,748,817 | 6/1988 | Oura et al. | 62/74 |

FOREIGN PATENT DOCUMENTS

| | | | |
|---|---|---|---|
| 1372024 | 8/1964 | France | 239/14.2 |

*Primary Examiner*—Andres Kashnikow
*Assistant Examiner*—Michael J. Forman
*Attorney, Agent, or Firm*—Wenderoth, Lind & Ponack

[57] ABSTRACT

An apparatus for generating falling snow and having an upright inner cylinder, a cloud vapor machine and a snow seed feeder connected to the cylinder near the lower end thereof, an air velocity adjustment pipe connected between the upper and lower ends thereof and a blower in the pipe for adjusting the flow velocity of air inside the pipe to adjust the flow of air in the inner cylinder, and a cooling tower surrounding the inner cylinder and a cooler for cooling the air in the cooling tower for cooling the inner cylinder. A deposited snow removing apparatus is provided which has a plurality of vibrators on the inner cylinder for vibrating the wall of the inner cylinder for removing snow deposited on the inner surface of the wall of the inner cylinder, a projector directing light into the upper part of the inner cylinder against the inner surface of the wall of the inner cylinder, a light receiver for receiving light reflected from the inner surface of the wall of the inner cylinder, and an operating device connected between the light receiver and the vibrators for operating the vibrators in response to the amount of light received in the light receiver.

3 Claims, 2 Drawing Sheets

APPARATUS FOR REMOVING SNOW DEPOSITED ON WALL OF SNOW GENERATING APPARATUS

BACKGROUND OF THE INVENTION

This invention relates to an apparatus for removing snow deposited on the wall of a snow generating apparatus, and more particularly relates to such an apparatus which removes snow deposited on the inner surface of the wall of an inner cylinder for growing the snow in the snow generating apparatus and which makes it possible to cause continuous snow generation.

An example of a snow generating apparatus is disclosed, for example, in copending U.S. application Ser. No. 920,194 in the name of Kenji ISONO et al., filed Oct. 17, 1986, now U.S. Pat. No. 4,746,064, issued May 24, 1988. This prior art apparatus will be described with reference to FIG. 2 of the accompanying drawings. This apparatus consists of an erect cooling tower 4', a snow collecting chamber 1' which is connected to the bottom of a cooling tower 4' and the ceiling opening 3' of which is covered by the cooling tower 4', a first cooler 9' connected to the tower 4' by ducts 10' and 11' for drawing off and cooling the internal air of the cooling tower 4' and then returning it to the cooling tower, an inner cylinder 12' which is disposed in such a manner as to extend inside the cooling tower 4' in the longitudinal direction thereof and which is open at the bottom for connection with the opening 3' of the snowfall chamber 1', a circulation pipe 13' which connects the top of the inner cylinder to the lower end, a variable speed blower 14' disposed at an intermediate portion of this circulation pipe 13', a humidifier 15' for receiving air drawn off from inner cylinder 12' through pipe 17' and if desired, diluted by outside air drawn through bypass pipe 18' controlled by valve 20', and supplying vapor through a pipe 16' into the inner cylinder 12' near the lower end portion of the inner cylinder 12', and a snow seed feeder 19 for supplying ice crystals into the inner cylinder near the humidifier 15'. The snow seed feeder 19 has an air compressor 23' supplying air to a further cooler 24' and then through pipe 22' to nozzle 21'.

The first cooler 9' cools the air within the cooling tower 4' so that the inner cylinder 12' and the circulation pipe 13' are cooled indirectly. A cold air stream having a predetermined velocity is formed in the ascending direction inside the inner cylinder 12' by operation of the variable speed blower 14' to pump air downwardly in circulation pipe 13'. The humidifier 15' is actuated to send the vapor into the inner cylinder and to form the cloud. This cloud is carried by the ascending cold air stream and stays in the upper part of the inner cylinder 12' as a supercooled cloud. When the snow seed feeder 19 is operated so as to supply ice crystals into the inner cylinder, they move upward, being carried by the ascending current in the same way as the cloud. When the ice crystals come into contact with the supercooled cloud in the upper part of the inner cylinder 12', a phenomenon which is the same as the natural phenomenon occurs there and snow is formed in the cloud and grows to a size which the ascending current cannot support any longer. Then, snow starts falling and drops into the snow collecting chamber through the opening 3'.

In the process of the growth of the snow in the upper part of the inner cylinder, a snow deposition phenomenon occurs when the floating snow comes into contact with the inner surface of the wall of the inner cylinder, and snow that has once been deposited there grows, and the cloud vapor and the ice crystals that are supplied are consumed by the deposited snow. Accordingly, the amount used for generating snow which falls drops below 30% of the amount fed. Furthermore, the deposited snow exhibits an adiabatic effect, reduces the cooling effect inside the inner cylinder and, hence, reduces the efficiency of the growth of the snow.

This conventional apparatus is therefore subject to the problem that it cannot remove the deposited snow. For this reason, it has not been possible by using the conventional snow generating apparatus to examine the influence of the amount of falling snow upon a testpiece in a continuous snowfall inside the snow chamber or to examine the continuous change of the forms of the snow that is progressively deposited onto the testpiece.

SUMMARY OF THE INVENTION

In order to eliminate the problem with the earlier invented apparatus as described above, the present invention employs the following means.

In a snow apparatus of the type wherein a cloud making machine and a snow seed feeder are directly connected to an upright inner cylinder, an air pipe with a blower means therein is connected between the top and the bottom of the inner cylinder to produce a flow velocity of the air inside the inner cylinder and a cooler is disposed on a cooling tower around the inner cylinder for cooling the inner cylinder, a plurality of vibrators are mounted on the wall of the inner cylinder where the snow is deposited so as to measure optically the state of the deposited snow. If snow deposition is observed, some of the vibrators are first operated and if removal of the deposited snow is not sufficient, the remaining vibrators are also operated. These vibrators are operated either continuously or intermittently by a timer so as to apply vibration to the inner surface of the wall of the inner cylinder to remove the snow deposited on the inner surface of the wall of the inner cylinder. In this manner, the apparatus of the invention prevents buildup of the deposited snow, improves the efficiency of growth of the snow and makes it possible to continuously produce snow which will fall to the bottom of the inner cylinder.

DESCRIPTION OF THE PREFERRED EMBODIMENT

Figure 1:
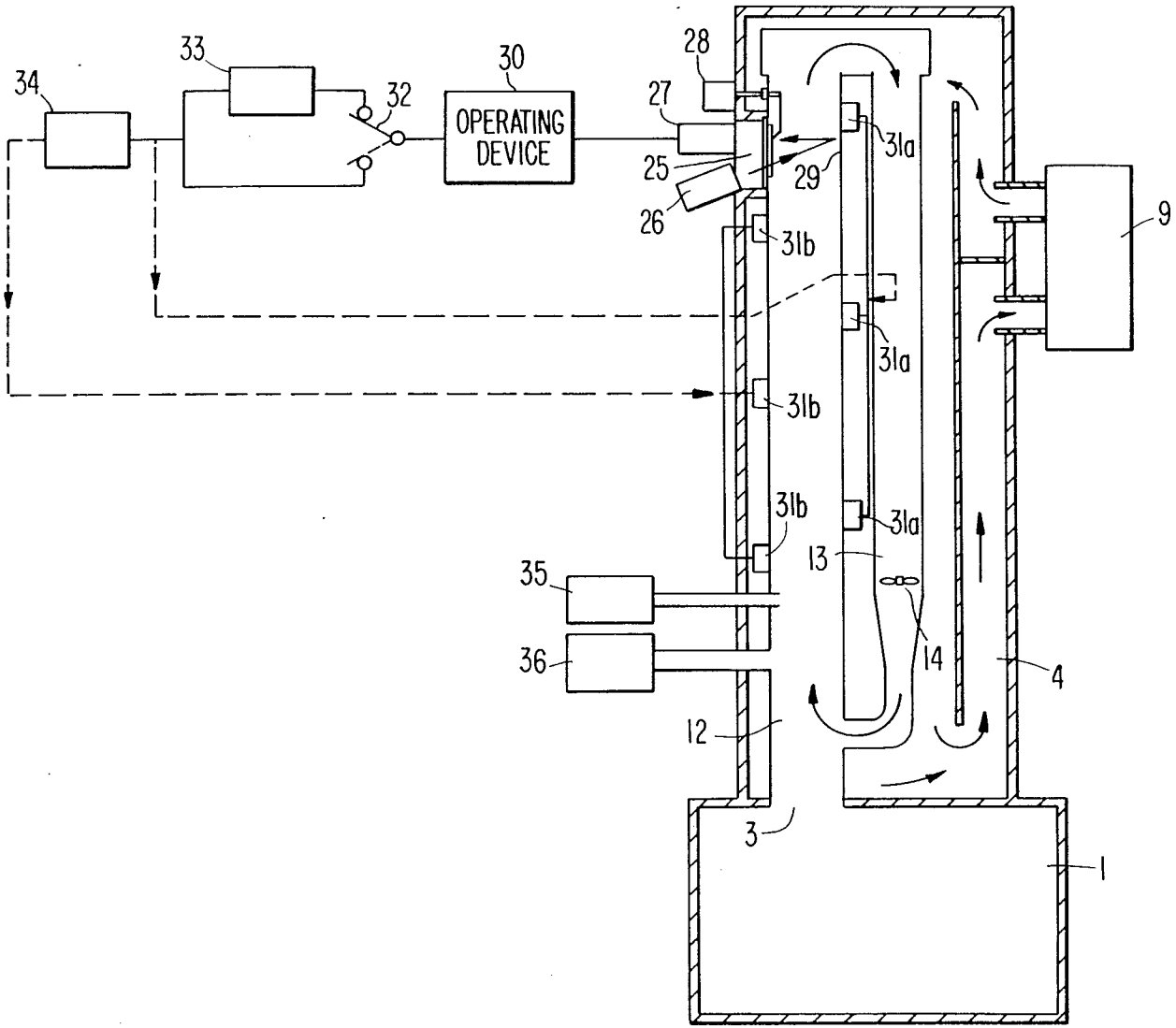
FIG. 1 is a schematic sectional elevation view of the apparatus of the present invention.
Figure 2:
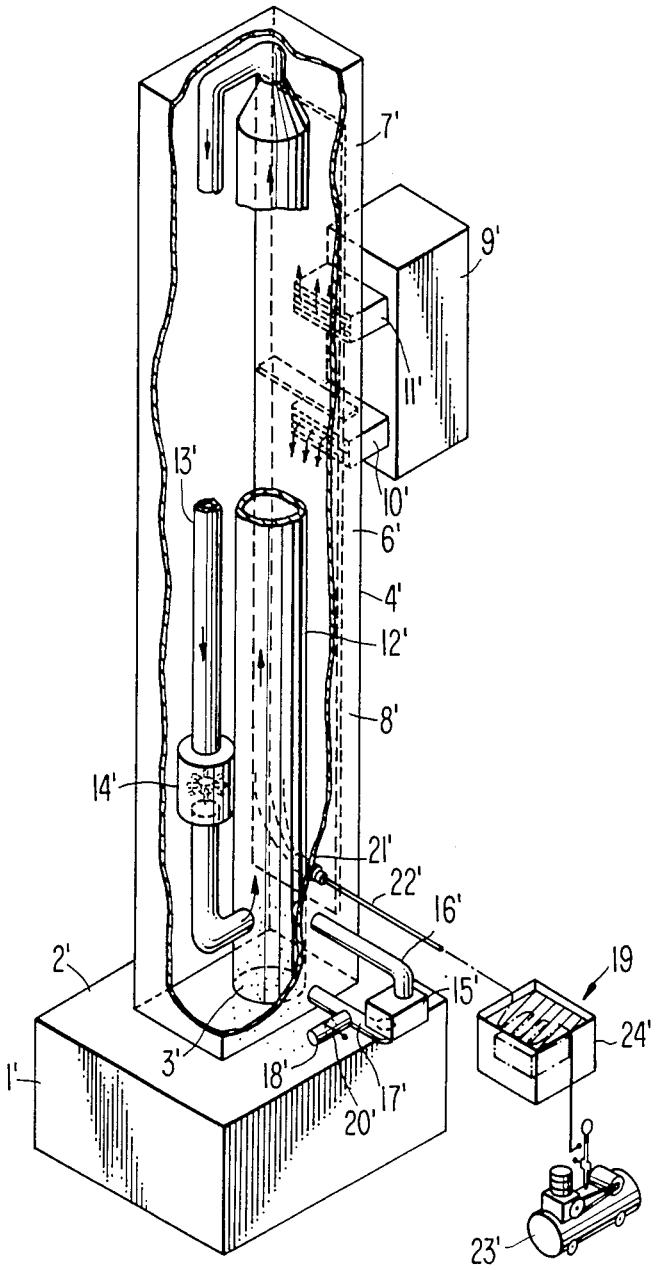
FIG. 2. (PRIOR ART)
FIG. 2 is a schematic perspective view, partly broken away, of a conventional apparatus.

Hereinafter, one preferred embodiment of the present invention will be described in detail with reference to FIG. 1.

An inner cylinder 12 which stands upright over an opening 3 formed in the ceiling of a snow collection chamber 1 is surrounded by a cooling tower 4. The air inside the cooling tower is cooled by a cooler 9 and circulated inside the cooling tower.

The air inside the inner cylinder 12 is circulated by a variable speed blower 14 in an air velocity adjustment air course pipe 13 connected between the lower and upper ends of inner cylinder 12 in a direction for providing an ascending current inside the inner cylinder. The temperature in the inner cylinder 12 is adjusted indirectly by adjusting the temperature inside the cooling tower 4 around the outer circumference of the inner cylinder, and this temperature ranges from −5° C. to −20° C. A cloud making machine 36 is connected directly to the inner cylinder 12 and supplies a vapor for cloud formation into the inner cylinder. A snow seed feeder 35 is also connected directly to the inner cylinder 12, and supplies snow seeds (ice crystals) as the nuclei for snowflake formation into the inner cylinder 12. When the inner cylinder is cooled to −15° C., for example, and the vapor from the cloud making machine 36 is sent into the inner cylinder, a cloud is formed in the upper part of the inner cylinder. When the ice crystals from the snow seed feeder 35 mix with the cloud, the ice crystals serve as nuclei and the growth of snowflakes starts. The snowflakes grow while floating in the upper part of the inner cylinder 12 and when they grow to a certain size, they are not supported by buoyancy in the ascending current and start falling, thereby causing a snowfall. Therefore, if the ascending current in the inner cylinder is kept slow, a fine snow falls because the buoyancy is small and if the ascending current is kept fast, the snow flakes must grow to a large size before they start falling because the buoyancy is great.

Though the snowflakes float in the space in the inner cylinder and grow as described above, some of the snow particles come into contact with the wall of the inner cylinder 12 cooled by the cooling tower 4, are deposited thereon and continue to grow. As the snow deposition proceeds on the wall of the inner cylinder and a snow layer is formed, the layer exhibits an adiabatic effect and cooling of the air within the inner cylinder 12 slows drastically. As a result, snow formation slows and eventually stops and snowfall does not occur at all.

To prevent this problem, according to the present invention, an inspection window 25 is formed in the wall of the inner cylinder 12, a projector 26 is disposed on the wall of the inner cylinder 12 adjacent the window 25 so as to project rays of light through the window, and a light receptor 27 is disposed adjacent the window in order to receive rays of light reflected from the wall 29 of the inner cylinder opposite the window 25. A wiper 28 is provided for the inspection window to remove the snow therefrom. The wall 29 facing the inspection window is colored black, for example, and since the quantity of the reflected rays of light is different depending on the degree of snow deposition, the degree of snow deposition can be distinguished easily. A first plurality of vibrators **31*a* is provided at points spaced vertically along the wall of the inner cylinder 12 on the side opposite the side with the window 25 therein. A second plurality of vibrators 31*b* is provided at points spaced vertically along the wall of the inner cylinder 12 on the same side as the window 25. An operating device 30 is connected to the output of light receptor 27, and the operating device 30 is connected to a switch 32 which can pass the output directly to the vibrators 31*a* or through a timer 33. The operating device output is also connected to vibrators 31*b* through a second timer 34**.

When snow deposition occurs on the wall of the inner cylinder, the quantity of the rays of light reflected from the wall 29 becomes great, the light receptor 27 detects this and produces a large current. When the quantity of the reflected light exceeds a predetermined value, the operating device 30 supplies an operation instruction to the vibrators **31*a* through the continuous vibration/intermittent vibration selection switch 32 and then either through the timer 33 from the switch 32 or bypassing the timer 33**.

The vibrators **31*a* and 31*b* are divided into blocks and are arranged in positions so as to provide vibration for removing the snow deposited inside the inner cylinder most effectively. The frequency of vibration of the vibrators is from 6,000 to 7,000 per minute, for example, and this vibration is applied to the wall of the inner cylinder to remove the deposited snow. The continuous vibration/intermittent vibration selection switch 32 selects whether the vibrators are caused to vibrate either continuously or intermittently, that is, repetition of vibration for a predetermined time and stopping of vibration for a predetermined time. Either of these modes can be selected in accordance with the conditions. In FIG. 1, intermittent vibration is shown as being selected (the full line position of switch 32). Therefore, if snow is deposited, the vibrators 31*a* vibrate for a predetermined time set by the timer 33**, then stop for a predetermined time and then repeats these vibrations.

The vibrators **31*a* apply vibrations of 6,000 to 7,000 per minute to the inner cylinder and the snow deposited on the wall of the inner cylinder is removed by this vibration. When the snow deposited on the black inner wall 9 is removed, the quantity of the reflected light drops drastically. The operating instruction from the operation device 30 to the vibrators 31*a* is stopped and the vibrators 31*a* stop their operation. On the contrary, if the deposited snow is removed even after the vibrator 31*a* continues in operation, the timer 34 operates after the passage of a predetermined period and supplies the operating instruction to the vibrators 31*b*. Then, the vibrators 31*b* start vibration of the inner cylinder. In other words, all of the vibrators 31*a* and 31*b*** operate to remove the deposited snow.

The vibration time and stop time of the timer 33 and the time of the timer 34 from the start of the vibrators **31*a* to the start of the vibrators 31*b*** are determined in accordance with the quality of the snow being generated.

After the snow deposited on the wall of the inner cylinder is removed by the operation of the vibrators **31*a* and 31*b*, the quantity of light received by the light receptor 27 drops drastically so that the operating device 30 discontinues the operating instruction so as to stop operation to the vibrators 31*a* and 31*b*, and the timer 34** returns to the zero position to prepare for the next instruction.

When the intermittent vibration mode is selected by the continuous vibration/intermittent vibration selection switch 32 as represented by the solid line position in FIG. 1, the vibrators **31*a* and 31*b* cause intermittent vibration and when the switch 32 is positioned to select the continuous vibration mode as represented by the dash line position in FIG. 1, the vibrators 31*a* and 31*b*** carry out continuous vibration.

Whenever the light receptor 27 detects snow deposition, the operations described above are carried out to remove the deposited snow and to improve the cooling of the inner cylinder. Since the cloud vapor supplied from the cloud vapor machine 36 and the snow crystals supplied from the snow seed feeder 35 can be used efficiently for forming the snow, steady continuous snowfall can be produced for the first time.

In the conventional snow generating apparatus, when the snow floating in the upper part of the inner cylinder during the snow growing process comes into contact with the wall of the cooled inner cylinder, it causes snow deposition thereon, and once the snow is deposited, it grows there. Accordingly, the cloud vapor and ice crystals that are supplied are consumed by this deposited snow and are not used for the falling snow. In addition, if snow deposition increases, the deposited snow creates an adiabatic effect on the cooling of the inner cylinder so that the cooling efficiency drops, the quantity of snow generated drops drastically and continuous snowfall becomes impossible.

In accordance with the present invention, on the other hand, if snow deposition occurs, even if it is slight, it is detected optically and the deposited snow is removed by the vibrators. Accordingly, the cloud vapor and ice crystals supplied can be used effectively for the falling snow, and the cooling is not hindered, and continuous falling snow becomes possible for the first time.

The present invention makes it possible to examine the influences of the quantity of snow deposited by continuous snowfall on a sample, the continuous change of the shapes of the snowflakes contacting the sample, and so forth, and to conduct various experiments and studies associated with snow damage.

Although the invention has been described with reference to one preferred form thereof, it is not particularly limited thereto. Accordingly, it will be obvious to those skilled in the art that various changes and modifications can be made without departing from the spirit and scope of the invention.

What is claimed is:

1. In an apparatus for generating falling snow and having an upright inner cylinder having an upper end and a lower end, a fallen snow collection chamber connected to the lower end of the upright cylinder, a cloud vapor machine for feeding water vapor into the inner cylinder in the vicinity of the lower end and a snow seed feeder connected to said cylinder near the lower end thereof, an air velocity adjustment pipe connected between the upper and lower ends of said inner cylinder, a blower connected to said air velocity adjustment pipe and means in said pipe for adjusting the flow velocity of air inside said pipe to adjust the flow of air in said inner cylinder, and a cooling tower surrounding said inner cylinder and a cooler for cooling the air in said cooling tower for cooling said inner cylinder, a deposited snow removing apparatus comprising:

a plurality of vibrators on said inner cylinder for vibrating the wall of said inner cylinder for removing snow deposited on the inner surface of the wall of said inner cylinder;

a projector directing light into the upper part of said inner cylinder against the inner surface of the wall of the inner cylinder;

a light receiver for receiving light reflected from said inner surface of the wall of said inner cylinder; and an operating device connected between said light receiver and said vibrators for operating said vibrators in response to the amount of light received in said light receiver.

2. A deposited snow removing apparatus as claimed in claim 1 further comprising a timer means for interrupting the output of said operating device, and mode selection means for selectively connecting said timer means between said operating device and said vibrators, whereby said vibrators can be operated continuously or intermittently under the control of said timer means.

3. A deposited snow removing apparatus as claimed in claim 1 in which said vibrators are divided into at least two groups, and said timer means includes a delay timer connected between said operating device and at least one of said groups for delaying the supply of the output of said operating device to said at least one of said groups, whereby said at least one of said groups does not begin vibrating until after the passage of a predetermined amount of time and the output of said operating means is still being supplied.

* * * * *